US007735687B2

(12) United States Patent
Fukushima et al.

(10) Patent No.: US 7,735,687 B2
(45) Date of Patent: Jun. 15, 2010

(54) BEVERAGE DISPENSER

(75) Inventors: Naoto Fukushima, Tatebayashi (JP); Hiroshi Yamamoto, Gyouda (JP); Takeshi Ishil, Fukaya (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 1060 days.

(21) Appl. No.: 11/334,495

(22) Filed: Jan. 19, 2006

(65) Prior Publication Data

US 2006/0169717 A1 Aug. 3, 2006

(30) Foreign Application Priority Data

Jan. 31, 2005 (JP) ..... 2005-023104

(51) Int. Cl.

| | |
|---|---|
| ***B67D 1/08*** | (2006.01) |
| ***B65B 1/04*** | (2006.01) |
| ***B05B 15/02*** | (2006.01) |
| ***B08B 3/00*** | (2006.01) |

(52) U.S. Cl. ..... 222/148; 222/129.1; 222/146.4; 141/90; 239/106; 239/566; 134/95.3; 134/102.3; 134/171; 118/302; 34/439; 34/443; 34/502

(58) Field of Classification Search ..... 222/148, 222/146.2, 146.4, 129.1, 129.2, 129.3, 129.4; 141/90, 91; 239/103, 104, 106, 566; 134/170, 134/171, 169 R, 183, 102.3, 95.2; 118/302; D7/1–5, 305, 306, 307, 308; 34/437, 439, 34/443, 502, 85, 241, 524, 179

See application file for complete search history.

(56) References Cited

U.S. PATENT DOCUMENTS

| | | | | |
|---|---|---|---|---|
| 3,876,144 | A * | 4/1975 | Madden et al. | 239/106 |
| 5,188,255 | A * | 2/1993 | Du | 222/1 |
| 5,350,082 | A * | 9/1994 | Kiriakides et al. | 221/1 |
| 5,862,840 | A | 1/1999 | Hansen | 141/90 |
| 6,616,763 | B2 * | 9/2003 | Spatafora | 118/323 |

FOREIGN PATENT DOCUMENTS

| | | |
|---|---|---|
| EP | 1 025 917 A1 | 8/2000 |
| GB | 1 241 791 | 8/1971 |
| GB | 2 367 105 A | 3/2002 |
| JP | 5-108945 | 4/1993 |
| JP | 6-211299 | 8/1994 |
| WO | WO91/17949 | * 11/1991 |

* cited by examiner

*Primary Examiner*—Kevin P Shaver
*Assistant Examiner*—Stephanie E Tyler
(74) *Attorney, Agent, or Firm*—Kratz, Quintos & Hanson, LLP

(57) ABSTRACT

An object is to smoothly clean a nozzle portion of a beverage dispenser, the beverage dispenser discharges and supplies beverage ingredients from beverage supplying nozzles, and comprises a cleaning device to clean the beverage supplying nozzles, and this cleaning device executes a cleaning operation including: a steam jetting step of jetting high-temperature steam to the beverage supplying nozzles; a water jetting step of jetting water or hot water to the beverage supplying nozzles; and a drying step of drying the surfaces of the beverage supplying nozzles.

7 Claims, 12 Drawing Sheets

FIG.9

| CLEANING STEP | PREPARE | JET STEAM | JET WATER | DRAIN | DRY | END |
|---|---|---|---|---|---|---|
| AIR PUMP | - | OFF | OFF | OFF | ON | - |
| AIR ELECTROMAGNETIC VALVE | - | CLOSED | CLOSED | CLOSED | OPENED | - |
| HEATER | | ON | ON | ON | ON | |
| COVER OPENING AND CLOSING MOTOR | ON/OFF | - | - | - | - | ON/OFF |
| NOZZLE MOVING MOTOR | ON/OFF | - | - | - | - | ON/OFF |
| ELECTROMAGNETIC PUMP | - | ON | ON | ON | OFF | - |
| ELECTROMAGNETIC VALVE | - | CLOSED | OPENED | CLOSED | CLOSED | - |
| ELECTROMAGNETIC VALVE | - | CLOSED | CLOSED | OPENED | CLOSED | - |
| DRAIN VALVE | - | OPENED | CLOSED | OPENED | CLOSED | - |

BEVERAGE DISPENSER

BACKGROUND OF THE INVENTION

The present invention relates to a beverage dispenser which discharges beverage ingredients from nozzles to supply the ingredients to a cup or the like together with diluting water, thereby providing beverage.

Heretofore, in a beverage dispenser for use in bag in box (BIB), a system is adopted in which a deriving tube drawn from the BIB is handled with a tube pump (peristaltic pump) to push a beverage ingredient out of the BIB, and the ingredient is mechanically mixed with diluting cooling water or cooling carbonated water to supply beverage (see, e.g., Japanese Patent Application Laid-Open No. 6-211299).

Moreover, in a beverage dispenser provided with a tank unit, the tank unit includes a beverage ingredient channel which supplies the beverage ingredient charged in a tank and which is provided with an electromagnetic valve and a flow regulator. The tank unit supplies the supplied beverage ingredient together with diluting water or carbonated water supplied from another tube to supply target beverage from a nozzle. In this case, the nozzle is a composite nozzle which discharges the target beverage in response to user's selection. A type of target beverage differs with different types of beverage ingredients supplied from a plurality of beverage ingredient tanks.

The beverage ingredients or the target beverages stick to and remain in these nozzles. If any measure is not taken, there is a danger that the remaining beverage ingredient goes rotten and becomes moldy in the worst case. To avoid the danger, it is considered that the beverage ingredient or the target beverage sticking to the nozzle be wiped off with cloth or the like, but this is not hygienically preferable. On the other hand, a system is adopted in which hot water or the like is passed through a beverage passage to clean the passage in an automatic dispenser or the like (see, e.g., Japanese Patent Application Laid-Open No. 5-108945).

However, it is difficult to completely remove the fixed beverage ingredient during the cleaning by use of hot water. It is also difficult to simultaneously sterilize and automatically dry the passage.

SUMMARY OF THE INVENTION

The present invention has been developed to solve such conventional technical problem, and an object is to smoothly clean a nozzle portion of a beverage dispenser.

A beverage dispenser of a first aspect of the present invention discharges and supplies beverage ingredients from beverage supplying nozzles, and comprises a cleaning device to clean the beverage supplying nozzles. This cleaning device executes a cleaning operation including: a steam jetting step of jetting high-temperature steam to the beverage supplying nozzles; a water jetting step of jetting water or hot water to the beverage supplying nozzles; and a drying step of drying the surfaces of the beverage supplying nozzles.

Moreover, in the beverage dispenser of a second aspect of the present invention, in the above-described invention, the cleaning device executes a draining step of removing water droplets from the surfaces of the beverage supplying nozzles between the water jetting step and the drying step during the cleaning operation.

Furthermore, in the beverage dispenser of a third aspect of the present invention, in the above-described inventions, the cleaning device comprises operation means for indicating start and end of the cleaning operation.

Additionally, in the beverage dispenser of a fourth aspect of the present invention, in the above-described inventions, the cleaning device comprises a cover which covers the beverage supplying nozzles during the cleaning operation.

Moreover, in the beverage dispenser of a fifth aspect of the present invention, in the above-described invention, the cleaning device comprises a cover driving device which opens and closes the cover.

Furthermore, in the beverage dispenser of a sixth aspect of the present invention, in the fourth or fifth aspect of the present invention, the cover covers lower parts of the beverage supplying nozzles, and front parts of the beverage supplying nozzles are covered with a main body door.

Additionally, in the beverage dispenser of a seventh aspect of the present invention, in the above-described inventions, the cleaning device comprises a cleaning nozzle for jetting steam to the beverage supplying nozzles in the steam jetting step, and the cleaning nozzle jets water or hot water in the water jetting step and jets drying air in the drying step and/or jets draining air in the draining step.

Moreover, in the beverage dispenser of an eighth aspect of the present invention, in the above-described invention, the cleaning device comprises a cleaning nozzle driving device which drives the cleaning nozzle into a state in which the cleaning nozzle is retreated from the beverage supplying nozzles and a state in which the cleaning nozzle faces the beverage supplying nozzles.

Furthermore, in the beverage dispenser of a ninth aspect of the present invention, in the above-described invention, the cleaning device swings the cleaning nozzle by means of the cleaning nozzle driving device.

Additionally, in the beverage dispenser of a tenth aspect of the present invention, in the seventh, eighth, or ninth aspect of the present invention, the cleaning nozzle is detachably attached.

Moreover, in the beverage dispenser of an eleventh aspect of the present invention, in the seventh, eighth, ninth, or tenth aspect of the present invention, the cleaning device comprises a drain valve device for controlling whether or not water is discharged from the cleaning nozzle, the drain valve device is closed in the water jetting step and the drying step, and the drain valve device is opened in the steam jetting step and/or the draining step.

Furthermore, in the beverage dispenser of a twelfth aspect of the present invention, in the above-described inventions, the cleaning device comprises: a water supply pump for pumping up water from a water source; and a steam generation device which heats water pumped up from the water supply pump to generate steam, and the cleaning device operates the water supply pump and the steam generation device to supply the steam to the cleaning nozzle in the steam jetting step and sucks water from the water source by use of the steam generated by the steam generation device and an aspirator to supply hot water to the cleaning nozzle in the water jetting step and/or sucks air by use of the steam and the aspirator to supply air to the cleaning nozzle in the draining step.

In addition, in the beverage dispenser of a thirteenth aspect of the present invention, in the above-described invention, the cleaning device further comprises: an air pump, and the cleaning device operates the air pump and the steam generation device to supply, to the cleaning nozzle, hot air obtained by heating air sucked by the air pump by means of the steam generation device in the drying step.

According to the first aspect of the present invention, the beverage dispenser which discharges and supplies the beverage ingredients from the beverage supplying nozzles comprises the cleaning device to clean the beverage supplying nozzles. This cleaning device executes the cleaning operation including: the steam jetting step of jetting high-temperature steam to the beverage supplying nozzles; the water jetting step of jetting water or hot water to the beverage supplying nozzles; and the drying step of drying the surfaces of the beverage supplying nozzles. Therefore, the beverage supplying nozzles can be cleaned by use of the high-temperature steam and water or hot water, and can be dried. Consequently, the beverage ingredients fixed to the beverage supplying nozzles can be quickly and securely removed. Moreover, it is possible to inhibit propagation of miscellaneous bacteria by means of the high-temperature steam, and sterilizing can be performed. Since dirt detached from the surfaces of the nozzles by means of the high-temperature steam is removed by water or hot water, the dirt on the nozzles can be removed more effectively. The nozzles can be dried to remarkably inhibit a disadvantage that the miscellaneous bacteria are propagated on the surfaces of the cleaned nozzles, and it is possible to hygienically maintain the beverage supplying nozzles.

Moreover, as in the second aspect of the present invention, the cleaning device executes the draining step of removing the water droplets from the surfaces of the beverage supplying nozzles between the water jetting step and the drying step during the cleaning operation. Accordingly, the water droplets remaining on the surfaces of the beverage supplying nozzles can be reduced to efficiently perform the subsequent drying step. In consequence, the beverage supplying nozzles can be efficiently dried.

Furthermore, as in the third aspect of the present invention, the cleaning device comprises the operation means for indicating the start and the end of the cleaning operation. Consequently, the cleaning operation of the beverage supplying nozzles can be arbitrarily executed in accordance with user's operation to instruct the cleaning operation.

Additionally, as in the fourth aspect of the present invention, the cleaning device comprises the cover which covers the beverage supplying nozzles during the cleaning operation. Accordingly, the high-temperature steam, water, or hot water does not fly or scatter around. The beverage supplying nozzles can be safely cleaned. Moreover, since the peripheries of the nozzles are pervaded with the steam in the cover, a cleaning and sterilizing effect is further improved. Since the beverage supplying nozzles are covered with the cover even after the end of the cleaning operation, it is possible to avoid a disadvantage that the beverage supplying nozzles are exposed to the outside air, for example, at a standby time after close of business.

Moreover, as in the fifth aspect of the present invention, the cleaning device comprises the cover driving device which opens and closes the cover. Accordingly, it is possible to automatically open and close the cover. In consequence, the cover can be closed by the cover driving device at the start of the operation of the cleaning device to prevent the cover from being left open. It is possible to avoid a disadvantage that the high-temperature steam, water, hot water or the like flies and scatters around owing to the forgetting to close the cover.

Furthermore, as in the sixth aspect of the present invention, the cover covers the lower parts of the beverage supplying nozzles, and the front parts of the beverage supplying nozzles are covered with the main body door. Accordingly, a constitution of the cover can be simplified. When the front parts of the beverage supplying nozzles are covered with the main body door, cleanability of the beverage supplying nozzles can be improved while securing operability.

Additionally, as in the seventh aspect of the present invention, the cleaning device comprises the cleaning nozzle for jetting the steam to the beverage supplying nozzles in the steam jetting step, and the cleaning nozzle jets water or hot water in the water jetting step and jets drying air in the drying step and/or jets draining air in the draining step. Accordingly, the steam jetting step, the water jetting step, and the drying step and/or the draining step can be realized using the same cleaning nozzle. In consequence the device can be miniaturized, and a constitution of piping or the like can be simplified.

Moreover, as in the eighth aspect of the present invention, the cleaning device comprises the cleaning nozzle driving device which drives the cleaning nozzle into the state in which the cleaning nozzle is retreated from the beverage supplying nozzles and the state in which the cleaning nozzle faces the beverage supplying nozzles. Therefore, the cleaning nozzle can be retreated during the supplying of beverage, that is, the dispensing of beverage to supply the beverage without interfering with the beverage supplying nozzles. During the cleaning, the cleaning nozzle driving device brings the cleaning nozzle into the state in which the nozzle faces the beverage supplying nozzles. Accordingly, the operation for cleaning the beverage supplying nozzles can be smoothly executed.

Furthermore, as in the ninth aspect of the present invention, the cleaning device swings the cleaning nozzle by means of the cleaning nozzle driving device. Accordingly, the cleaning nozzle can effectively jet, to the beverage supplying nozzles, the high-temperature steam, water, hot water, drying air or the like. In consequence, a cleaning and drying effect is further improved.

Additionally, as in the tenth aspect of the present invention, the cleaning nozzle is detachably attached. Accordingly, the cleaning nozzle can be removed to easily perform maintenance with respect to the cleaning nozzle or a portion from which the cleaning nozzle has been removed.

Moreover, as in the eleventh aspect of the present invention, the cleaning device further comprises a drain valve device for controlling whether or not water is discharged from the cleaning nozzle, and the drain valve device is closed in the water jetting step and the drying step. Accordingly, water, hot water, or drying air supplied to the cleaning nozzle can be effectively jetted from the cleaning nozzle. The drain valve device is opened in the steam jetting step and/or the draining step. Accordingly, when water other than the steam and hot air is discharged, temperature of the steam or hot air jetted from the cleaning nozzle drops, and a cleaning capability or a drying capability can be inhibited from being deteriorated.

Furthermore, as in the twelfth aspect of the present invention, the cleaning device comprises: the water supply pump for pumping up water from the water source; and the steam generation device which heats water pumped up from the water supply pump to generate the steam, and the cleaning device operates the water supply pump and the steam generation device to supply the steam to the cleaning nozzle in the steam jetting step and sucks water from the water source by use of the steam generated by the steam generation device and the aspirator to supply hot water to the cleaning nozzle in the water jetting step and/or sucks air by use of the steam and the aspirator to supply air to the cleaning nozzle in the draining step. Since the steam generated by heating water is used, it is possible to jet, to the beverage supplying nozzles, hot water or hot air mixed with the high-temperature steam not only in the steam jetting step but also in the water jetting step or the draining step.

In consequence, it is possible to improve the cleaning effect in the water jetting step and improve a water droplet removing capability in the draining step by use of the steam for use in the steam jetting step, and a high cleaning and drying capability can be obtained with a simple constitution.

In addition, as in the thirteenth aspect of the present invention, the cleaning device further comprises: the air pump, and the cleaning device operates the air pump and the steam generation device to supply, to the cleaning nozzle, hot air obtained by heating air sucked by the air pump by means of the steam generation device in the drying step. Consequently, it is possible to realize effective drying by means of hot air.

BRIEF DESCRIPTION OF THE DRAWINGS

FIG. 9 is an explanatory view of each cleaning step;

DETAILED DESCRIPTION OF THE PREFERRED EMBODIMENT

An embodiment of the present invention will be described hereinafter with reference to the drawings.

Embodiment 1

Figure 1:
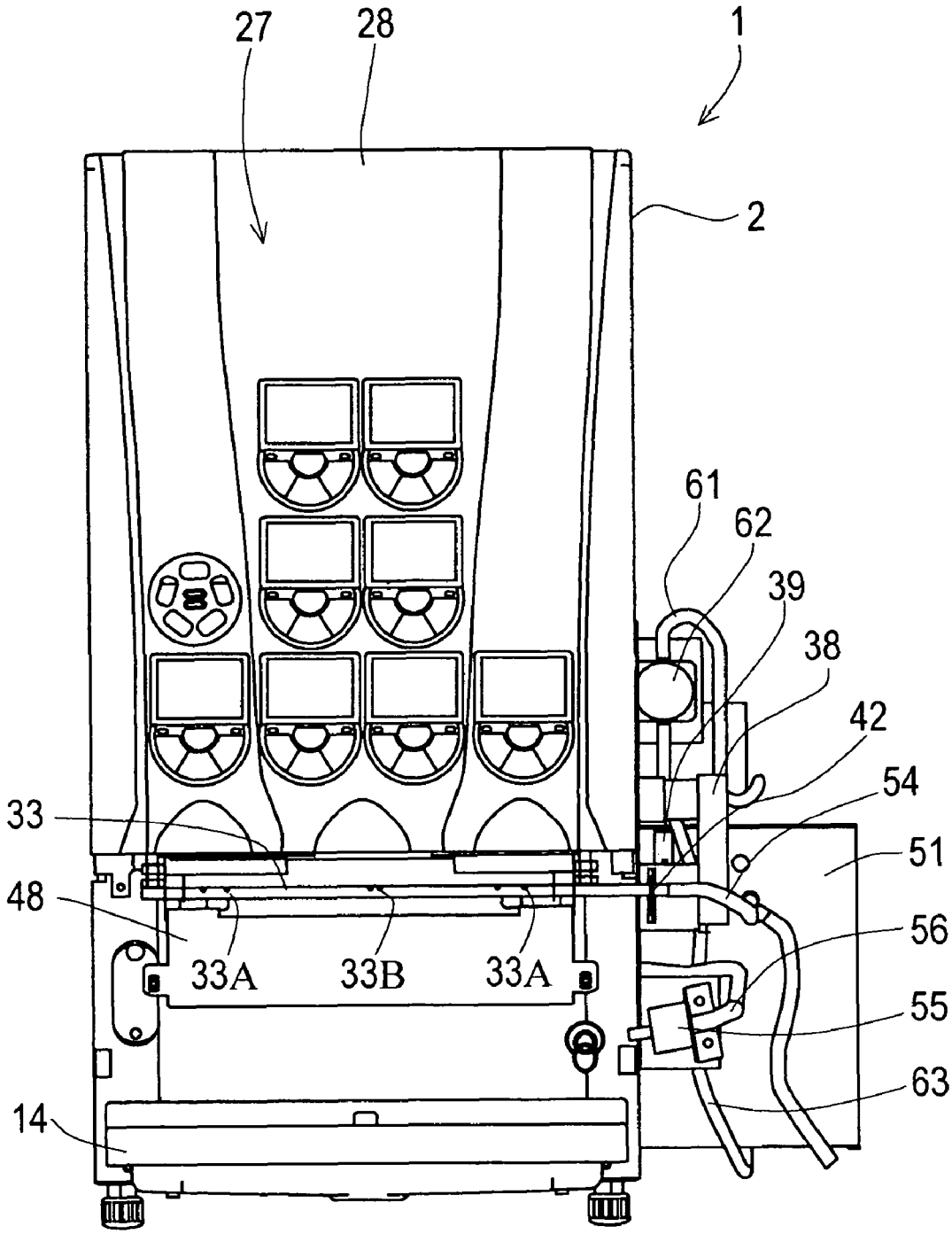
FIG. 1 is a front view of a beverage dispenser to which the present invention is applied (dispensing state in which a cover is opened and a cleaning nozzle is retreated)
Figure 2:
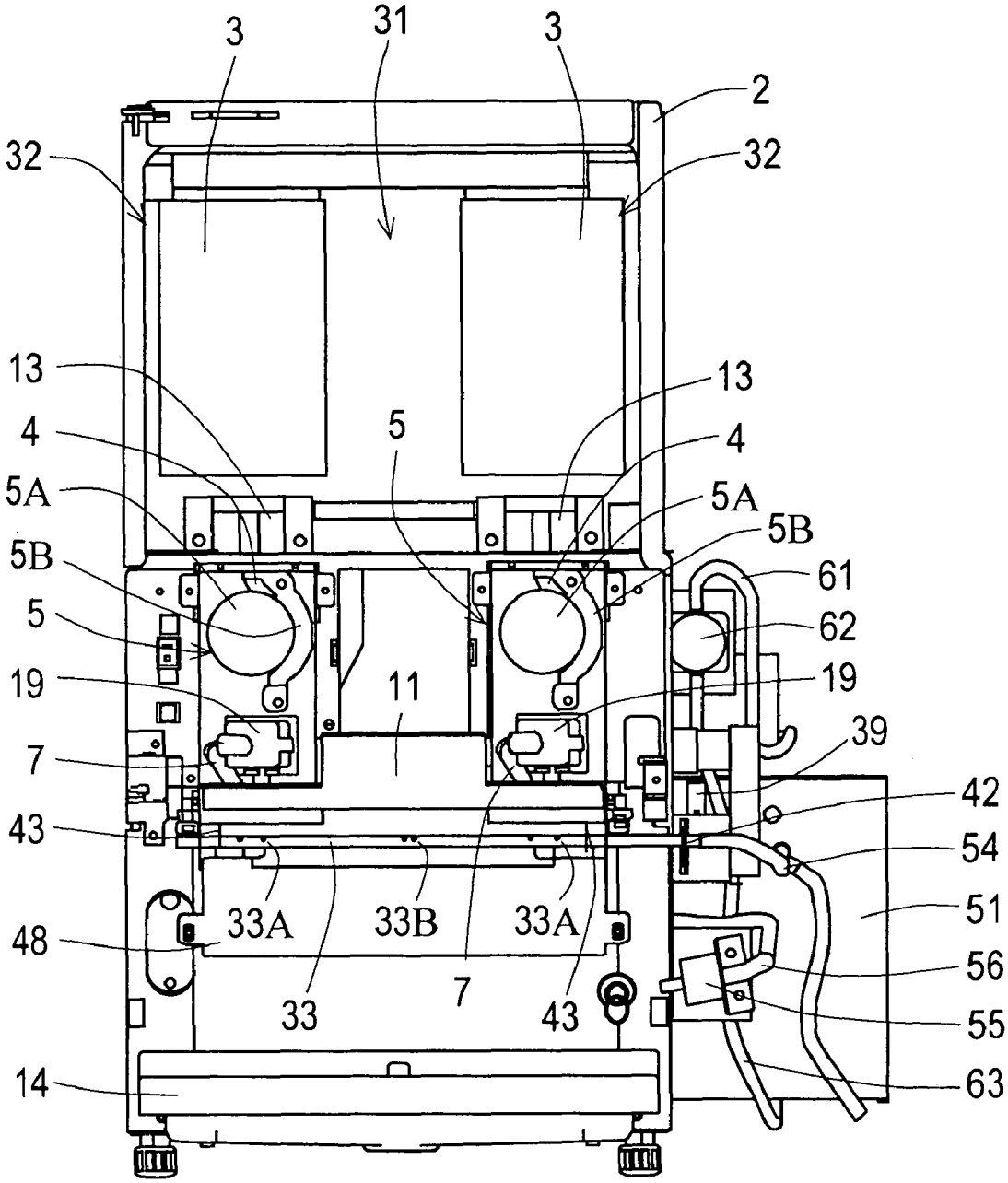
FIG. 2 is a front view in a state in which a front door of FIG. 1 is removed.

A beverage dispenser 1 of an embodiment is a BIB beverage dispenser for use in a restaurant, a coffee shop or the like, and is a device provided with a main body 2 containing: BIB units 32, 32 which supply uncarbonated beverages such as oolong tea and orange juice; and a tank unit 31 connected to a tank (not shown) which supplies strongly and lightly carbonated and uncarbonated target beverages. Such beverage dispenser 1 is structured such that the tank unit 31 is disposed in the center and the BIB units 32, 32 are disposed on opposite sides as shown in FIG. 2. Moreover, the tank unit 31 and the BIB units 32, 32 are shielded behind an openably closed door 28 positioned in the front.

The front of the opening/closing door 28 is provided with an operation section 27 which operates the supplying of the beverage from the tank unit 31 and the BIB units 32, 32. The section is provided with operation buttons such as buttons S, M, L, and C/P which select a beverage supply amount or a beverage supply method for each beverage to be supplied from each unit. The buttons S, M, and L are buttons to operate the supply of a predetermined amount of beverage, and the button C/P is a button which supplies the beverage only while operated. It is to be noted that the operation section 27 is provided with a cleaning button (not shown) for starting or ending (stopping) cleaning operations of beverage supplying nozzles 6, 7, and 12 described later in detail.

Figure 4:
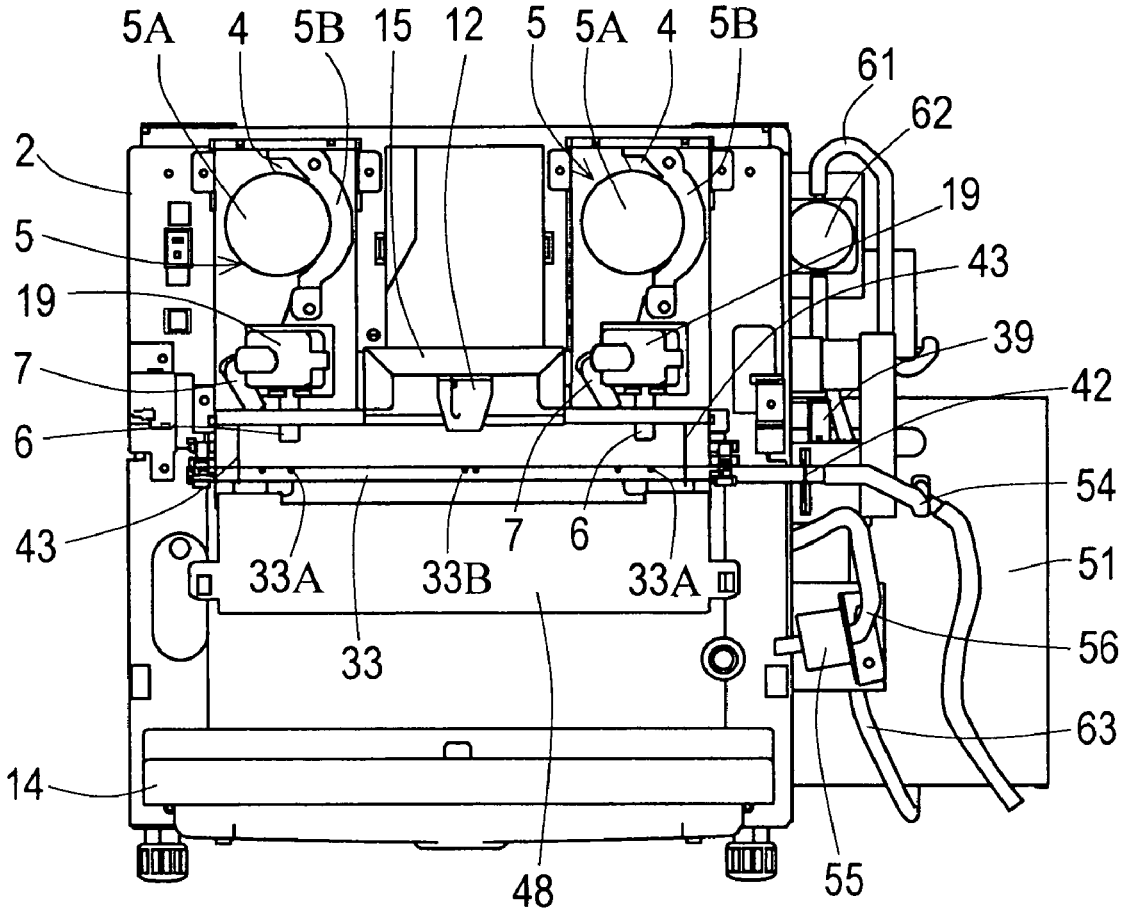
FIG. 4 is an enlarged lower-part diagram in a state in which a front plate of FIG. 2 is removed.

The tank unit 31 is constituted by disposing an electromagnetic valve and a flow regulator (not shown) in a beverage ingredient channel which supplies beverage ingredients. Furthermore, the tank unit 31 is provided with the nozzle (beverage supplying nozzle) 12 which discharges the target beverage obtained by mixing the beverage ingredient with diluting water supplied from another tube. It is to be noted that in FIG. 2, the front of the nozzle 12 is covered with a front plate 11. It is to be noted that this front plate 11 is attached to the backside of the opening/closing door 28. It is assumed that a gasket (not shown) is disposed in a portion of the front plate 11 which abuts on the main body 2. It is also assumed that an abutment plate 15 is attached to a portion of the main body 2 which abuts on the gasket so as to keep away from the nozzle 12 as shown in FIG. 4.

Figure 3:
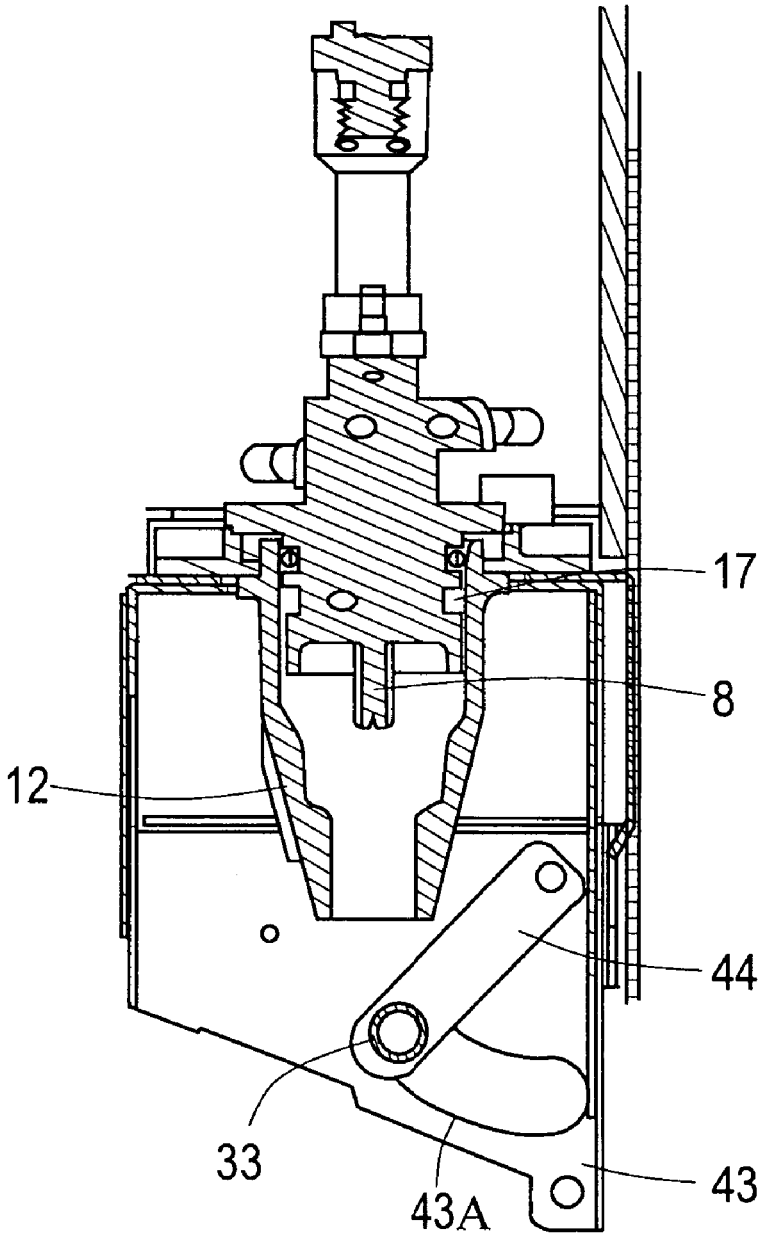
FIG. 3 is an enlarged vertical side view of a beverage supplying nozzle.

The nozzle 12 is a composite nozzle which discharges the target beverage in response to user's selection. A type of target beverage differs with different types of beverage ingredients supplied from a plurality of beverage ingredient tanks. The nozzle is disposed opening downwards as shown in FIG. 3. In an inner part (upper part) of this nozzle 12, there are disposed: a syrup line 8 via which the beverage ingredient (syrup) is supplied and discharged; and a carbonated water/diluting water line 17 which is disposed around the syrup line and which discharges carbonated water or diluting water along an inner face of the nozzle 12.

Next, an opaque deriving tube 4 of a BIB 3 of each BIB unit 32 is sandwiched between a rotor 5A and an arm 5B of a pump (peristaltic pump) 5 via a sold-out detecting sensor 13. A lower end (hereinafter referred to as the nozzle (beverage supplying nozzle) 6) of the deriving tube 4 is drawn out via a pinch solenoid 19 disposed under the pump 5, and the beverage ingredient is supplied via the nozzle 6. It is to be noted that in FIG. 2, the front of the nozzle 6 is covered with the front plate 11.

The pump 5 successively handles the deriving tube 4 by means of a plurality of rollers attached to the rotor 5A to push out the beverage ingredient. Furthermore, the diluting water nozzle 7 is disposed adjacent to the beverage ingredient nozzle 6.

A table 14 provided with a drip tray is disposed under the nozzles 6, 7 of the BIB unit 32 and the nozzle 12 of the tank unit 31, and a cup guided by a guide (not shown) is disposed on the table 14.

It is to be noted that in the main body 2, there are disposed a compressor and a condenser of a cooling device (not shown) for cooling diluting water and the like, and a diluting water pump motor. A water tank and a carbonator (not shown) are also disposed in the main body 2.

In the above-described constitution, when the beverage starts to be dispensed from the BIB 3, the pump 5 is driven for a preset dispensing time to discharge the beverage ingredient from the nozzle 6. The diluting water electromagnetic valve (not shown) is opened to discharge the diluting water from the nozzle 7. Moreover, in a case where the set dispensing time elapses, the pump 5 is stopped, and the diluting water electromagnetic valve is closed. Moreover, the pinch solenoid 19 is closed. Accordingly, a predetermined amount of beverage ingredient is diluted with the diluting water for the dispensing time to supply, into the cup, an uncarbonated beverage having a predetermined concentration.

Moreover, during the dispensing of the carbonated beverage, electromagnetic valves (not shown) are opened which are disposed in the syrup line 8 and the carbonated water/diluting water line 17 to discharge the beverage ingredient and carbonated water (or diluting water) into the nozzle 12 shown in FIG. 3. The beverage ingredient and carbonated water discharged into the nozzle 12 are supplied into the cup via a lower-end opening of the nozzle.

When the beverage is supplied in this manner, the beverage ingredient sticks to and remains in the respective beverage supplying nozzles 6, 12, and is dried and fixed. The beverage ingredient, carbonated water, or diluting water flies and scatters to contaminate peripheries of the beverage supplying nozzles 6, 7, and 12. Then, a cleaning device 30 executes a cleaning operation as described below.

Figure 6:
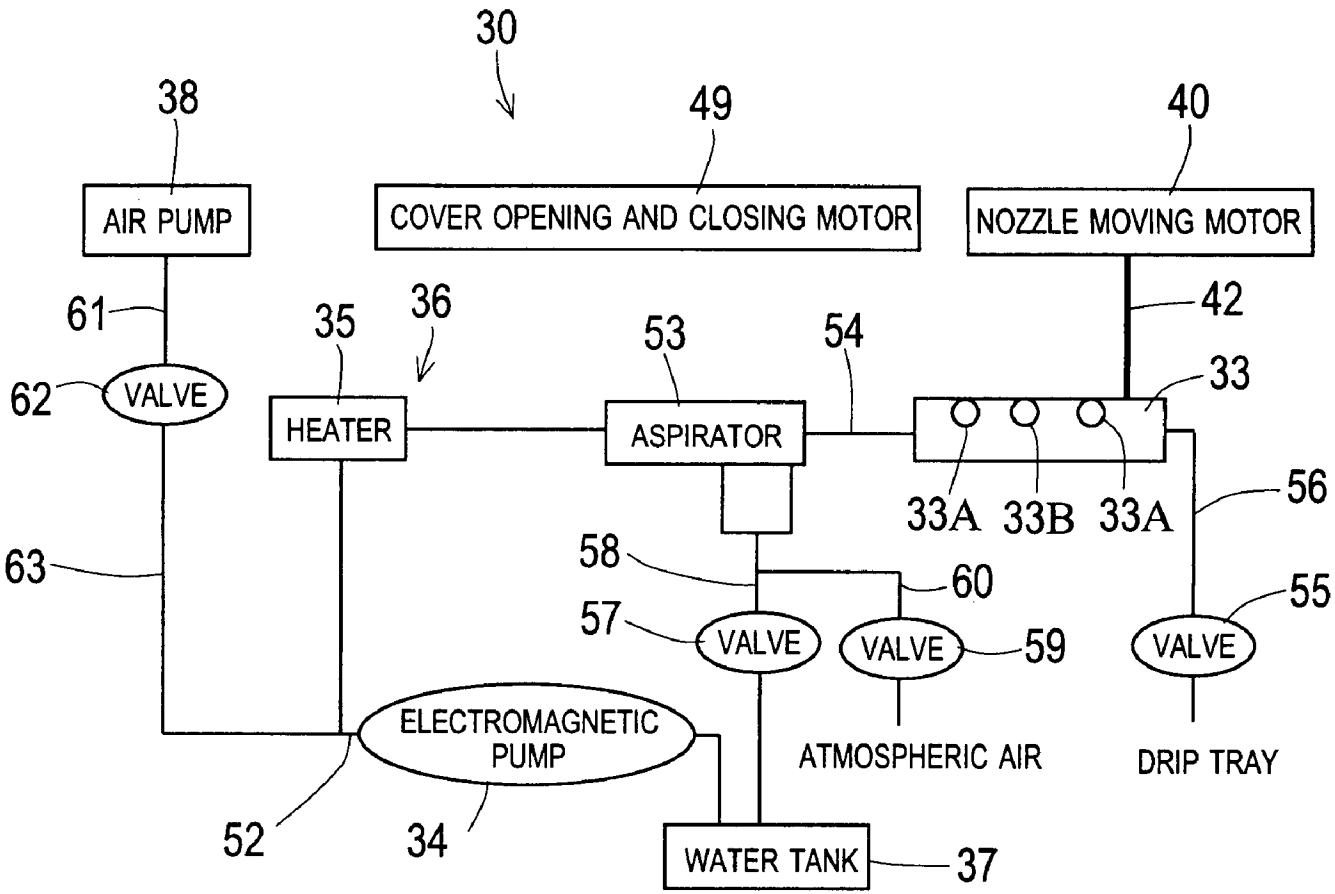
FIG. 6 is a schematic constitution diagram of a cleaning device.

First, the cleaning device 30 of the beverage dispenser 1 will be described with reference to FIG. 6. The cleaning device 30 is constituted of: a nozzle 33 disposed under the beverage supplying nozzles 6, 7, and 12; an electromagnetic pump (water supply pump) 34 disposed on the side face of the main body 2; a steam generation device 36 including a heater 35; a water tank 37 (shown in FIG. 6 only) as a water source; and an air pump 38.

The nozzle 33 is a tubular member having a plurality of discharge ports 33A, 33A, and 33B which jet upwards steam, hot water, hot air and the like to positions facing the beverage supplying nozzles 6, 7, and 12, respectively, as described later. A cleaning nozzle driving device 39 disposed on the side face of the main body 2 can move the nozzle into a state in which the nozzle is retreated backwards from the beverage supplying nozzles 6, 7, and 12 and a state in which the nozzle faces the beverage supplying nozzles 6, 7, and 12.

Figure 7:
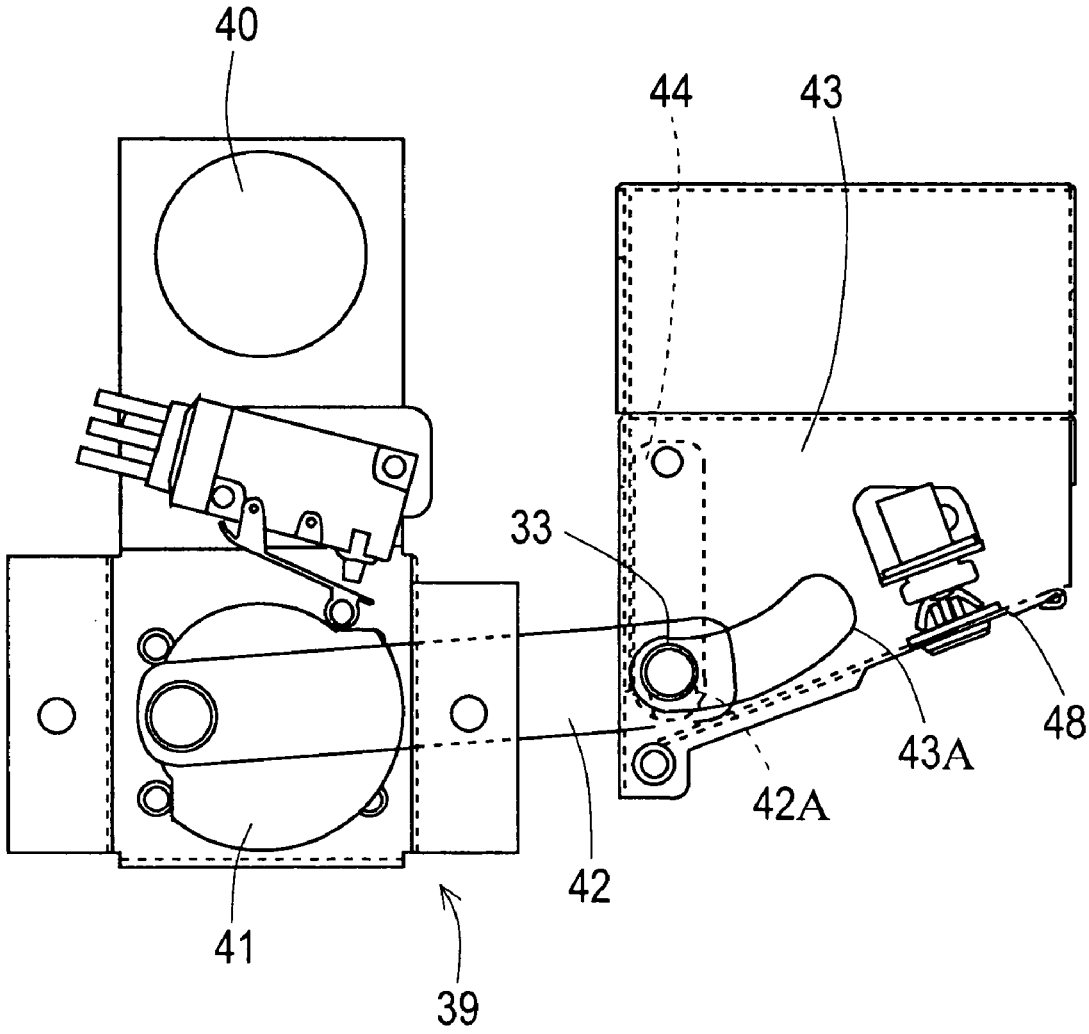
FIG. 7 is an enlarged partial diagram in a state in which the cover is closed and the cleaning nozzle is retreated (cleaning preparatory step)

As shown in a partially enlarged vertical side view of FIG. 7 viewed from the side of the main body 2, this cleaning nozzle driving device 39 is constituted of: a nozzle moving motor 40 disposed in the main body 2; an eccentric cam 41 driven by the nozzle moving motor 40 to rotate in one direction; and an arm 42 which is movable forwards and backwards with the movement of the cam 41. A front part of the arm 42 is provided with an engaging portion 42A including downwards, and the cleaning nozzle 33 is detachably held by the engaging portion 42A. It is to be noted that the nozzle moving motor 40 is connected to a control device (not shown), and controlled based on the control device.

Figure 8:
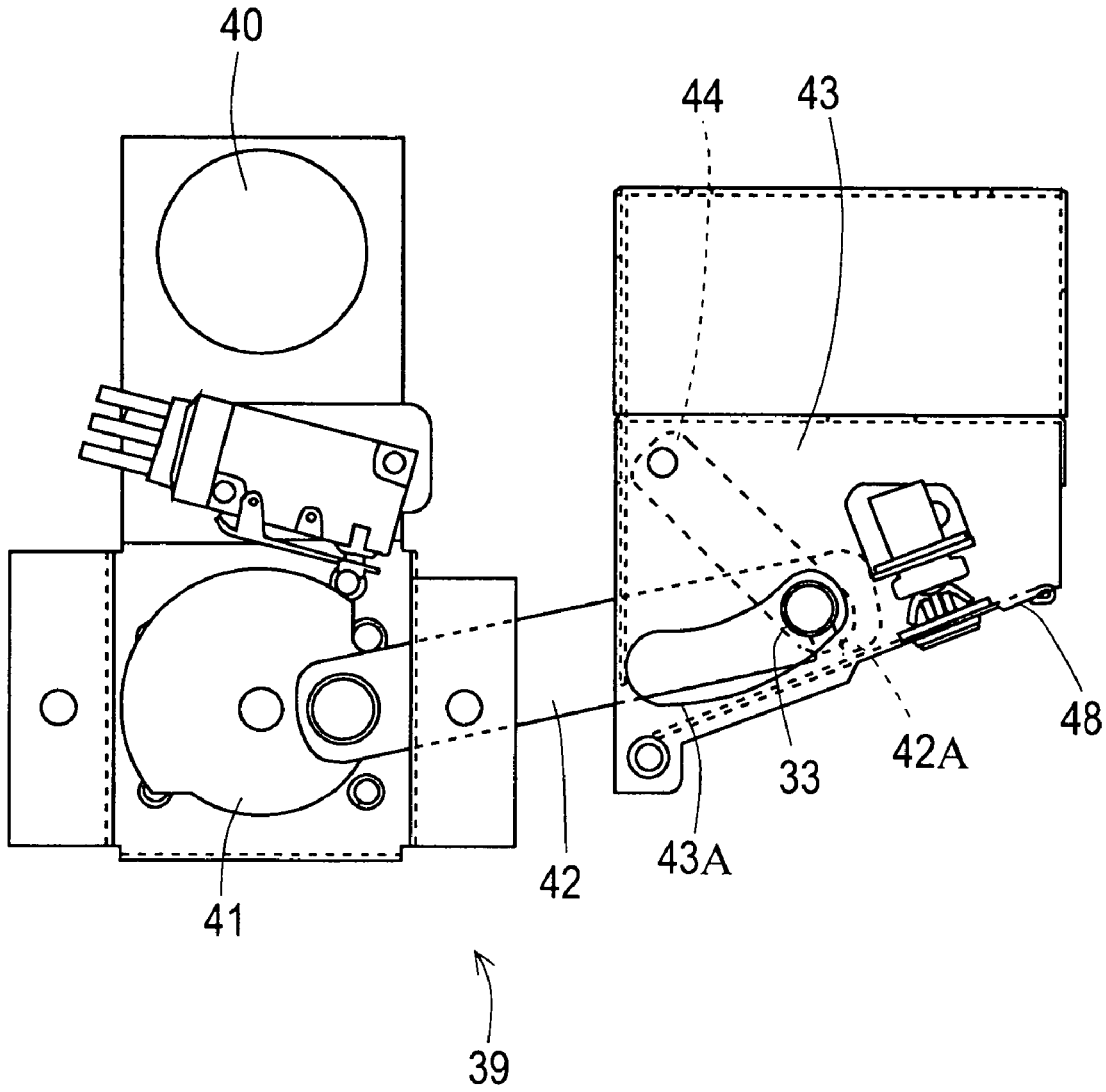
FIG. 8 is an enlarged partial diagram in a state in which the cover is closed and the cleaning nozzle faces a beverage supplying nozzles (cleaning step)

Moreover, the front of this main body 2 is provided with an orientation plate 43 including an elongated hole 43A for orienting the cleaning nozzle 33 into opposite side portions corresponding to a state in which the cleaning nozzle is allowed to face the beverage supplying nozzles 6, 7, and 12 (FIG. 8) and a state in which the cleaning nozzle is retreated backwards (FIG. 7) with rotation of the cam 41. Furthermore, in this orientation plate 43, there is disposed a guide member 44 whose one end is rotatably attached to the orientation plate 43 and whose other end disengageably holds the cleaning nozzle 33. Accordingly, the cleaning nozzle 33 is driven by the nozzle moving motor 40 to move forwards and backwards via the arm 42. Moreover, the cleaning nozzle rotates centering on one end of the guide member 44 to smoothly move in the elongated hole 43A of the orientation plate 43. The cleaning nozzle 33 is smoothly movable into such state as to face the beverage supplying nozzles 6, 7, and 12 and the backward retreated state.

Furthermore, a cover 48 rotatable upwards centering on an upper end is attached to the front face of the main body 2 positioned under the beverage supplying nozzles 6, 7, and 12 and the cleaning nozzle 33. In the present embodiment, it is assumed that the cover 48 is a cover member which covers the cleaning nozzle 33 from below, and is opened and closed by a cover driving device (not shown). The cover driving device drives and controls a cover opening and closing motor 49 to open and close the cover 48, and a mechanism of the device is substantially the same as that of the cleaning nozzle driving device 39.

It is to be noted that in the present embodiment, the cover 48 covers lower parts of the cleaning nozzle 33 and the beverage supplying nozzles 6, 7, and 12, and the front parts of the cleaning nozzle 33 and the beverage supplying nozzles 6, 7, and 12 are covered with the door 28 and the front plate 11 of the main body 2 as described above.

On the other hand, the electromagnetic pump 34 and the steam generation device 36 are stored in a storage case 51, and disposed in the side face of the main body 2. The electromagnetic pump 34 is a pump which feeds water pooled in the water tank 37 to the steam generation device 36 via a water pipe 52. After water fed out by the steam generation device 36 is heated by the heater 35 at a high temperature, water is discharged to the cleaning nozzle 33 via a pipe 54 connected to an aspirator 53. The other end of the cleaning nozzle 33 is connected to a drain pipe 56 provided with a drain valve (drain valve device) 55, and the drain pipe 56 is opened toward a drip tray disposed on the table 14.

Moreover, the aspirator 53 is connected to a pipe 58 whose one end is connected to the water tank 37 and provided with an electromagnetic valve 57. Furthermore, the aspirator 53 is connected to a pipe 60 whose one end is opened to the atmospheric air and provided with an electromagnetic valve 59. On the other hand, the air pump 38 is connected to an air electromagnetic valve 62 via a pipe 61, and the air electromagnetic valve 62 is connected to the water pipe 52 and the steam generation device 36 via a pipe 63. It is to be noted that the electromagnetic pump 34, the heater 35, the air pump 38, the drain valve 55, the electromagnetic valves 57, 59, and the air electromagnetic valve 62 are connected to the control device.

Figure 5:
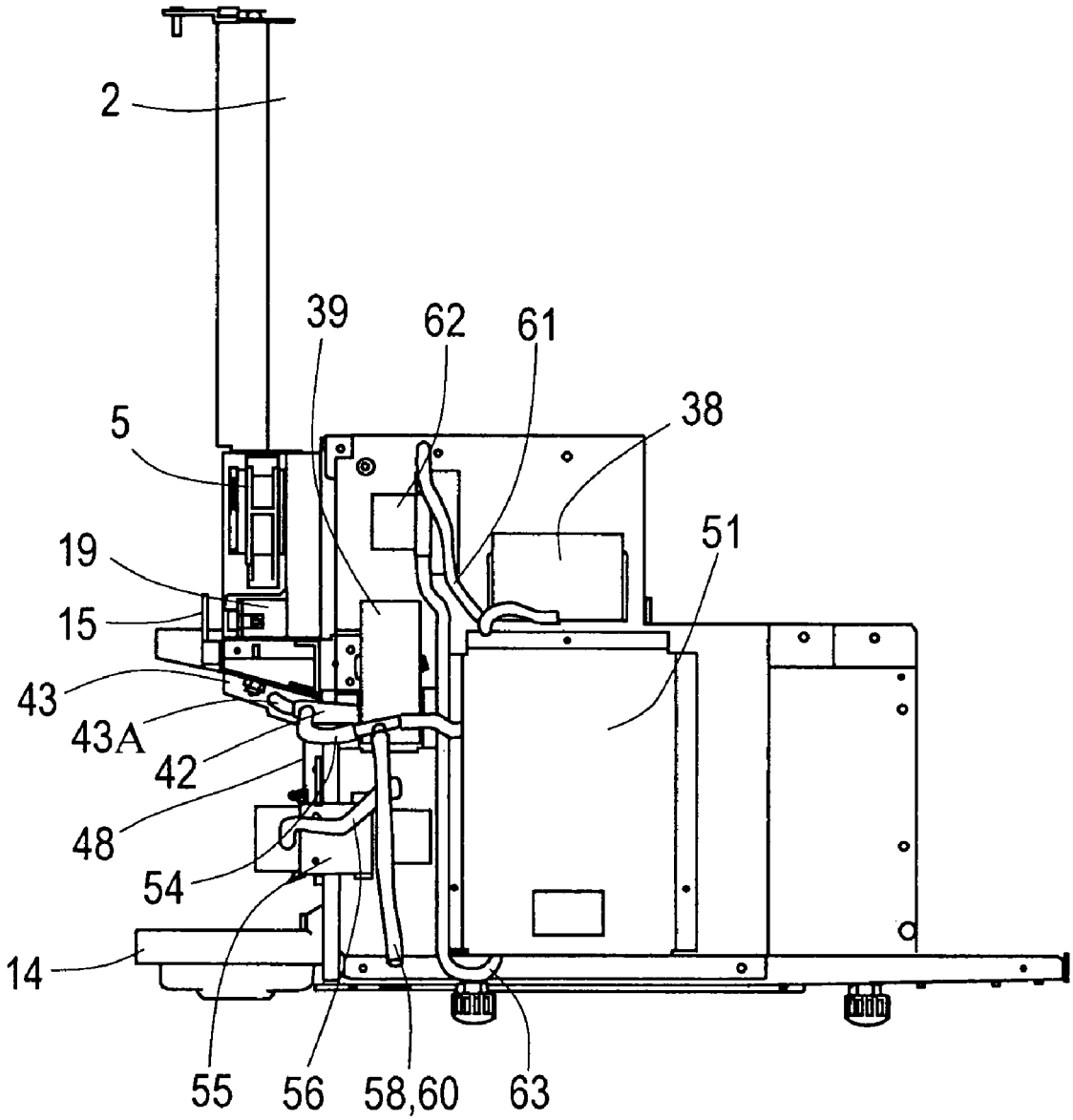
FIG. 5 is a partial side view of FIG. 4.

There will be described an operation of the cleaning device 30 constituted as described above with reference to FIG. 9. It is to be noted that during the beverage dispensing before starting the operation to clean the beverage supplying nozzles 6, 7, and 12 by means of the cleaning device 30, as shown in FIGS. 4 and 5, the cleaning nozzle 33 is retreated backwards, and the cover 48 is opened. First, when the cleaning button is operated which is disposed in the operation section 27 disposed on the door 28 of the beverage dispenser 1, the control device successively executes a cleaning preparatory step, a steam jetting step, a water jetting step, a draining step, a drying step, and an ending step.

Figure 10:
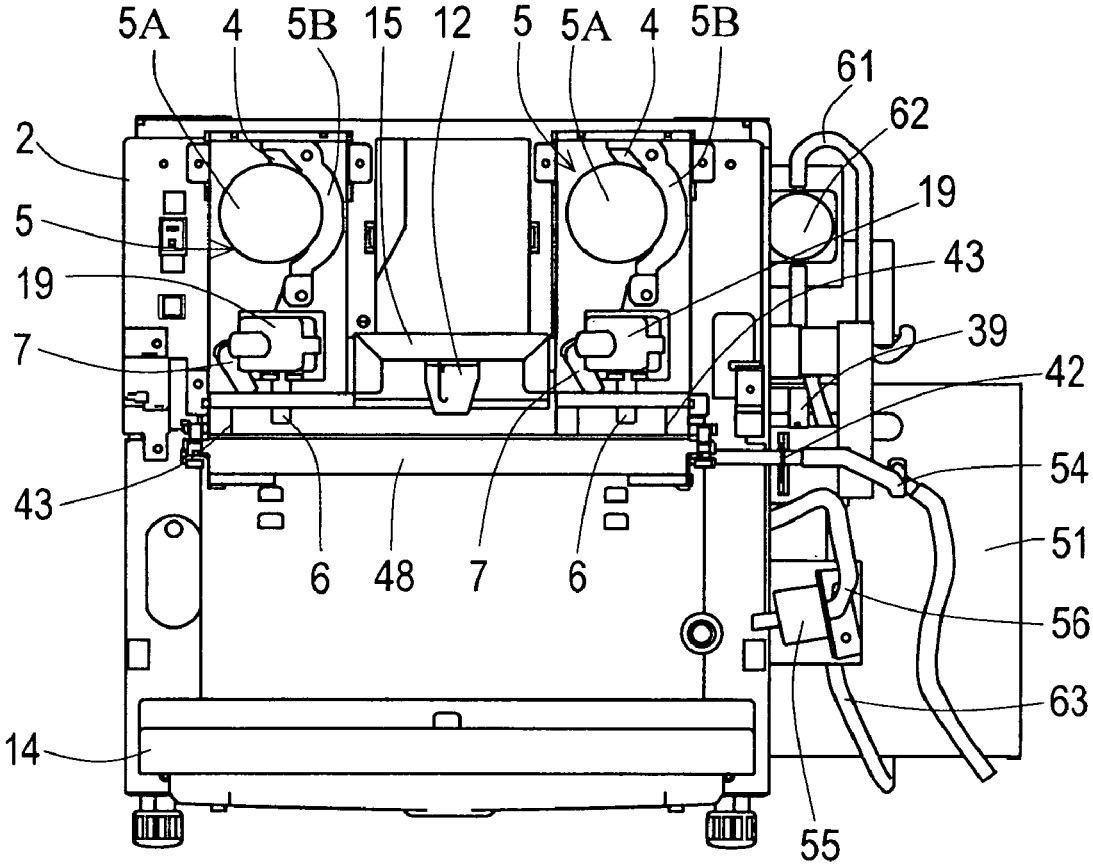
FIG. 10 is a diagram showing a state in which the cover of FIG. 3 is closed (the state in which the cover is closed and the cleaning nozzle is retreated)
Figure 11:
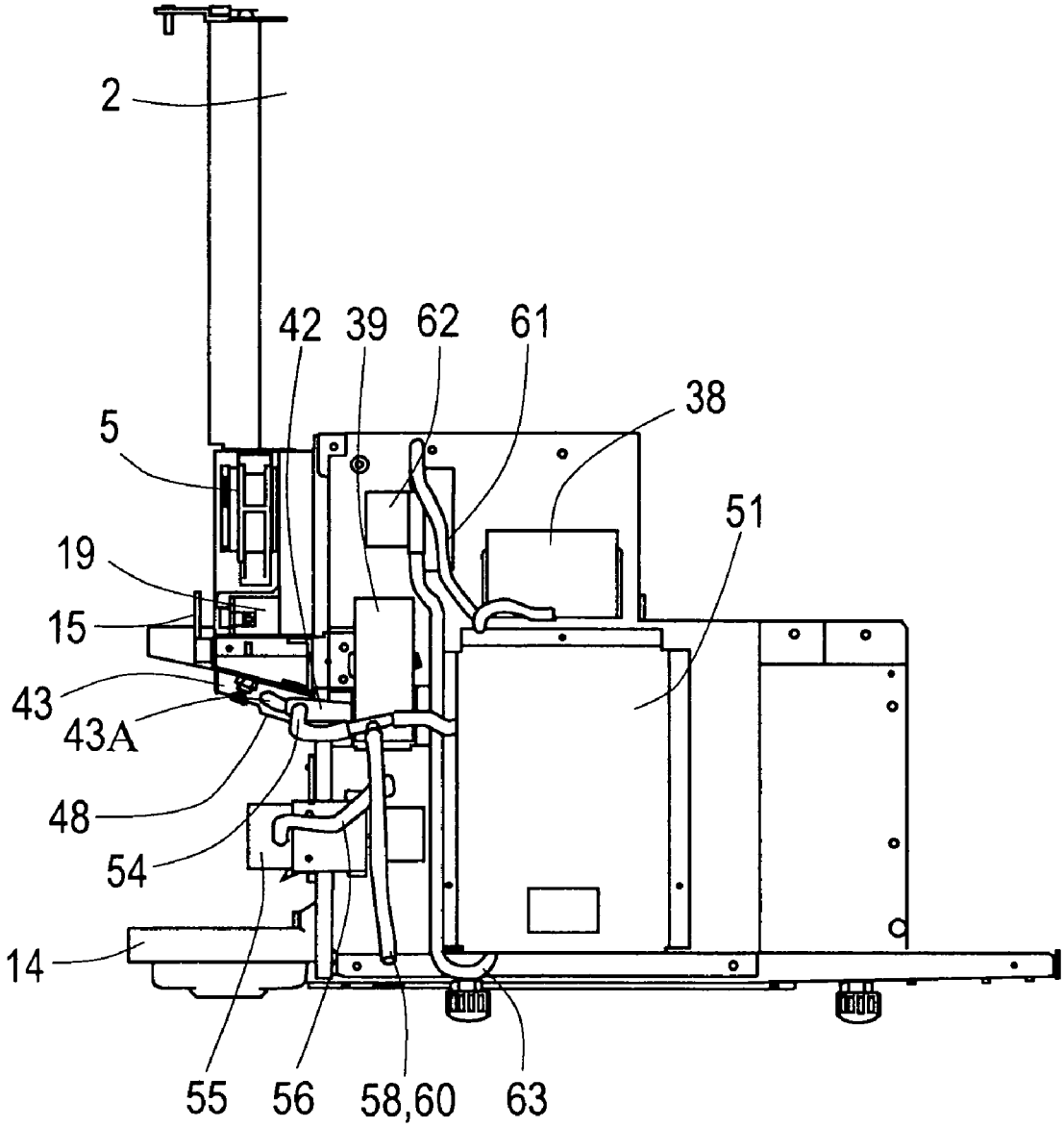
FIG. 11 is a partial side view of FIG. 10.
Figure 12:
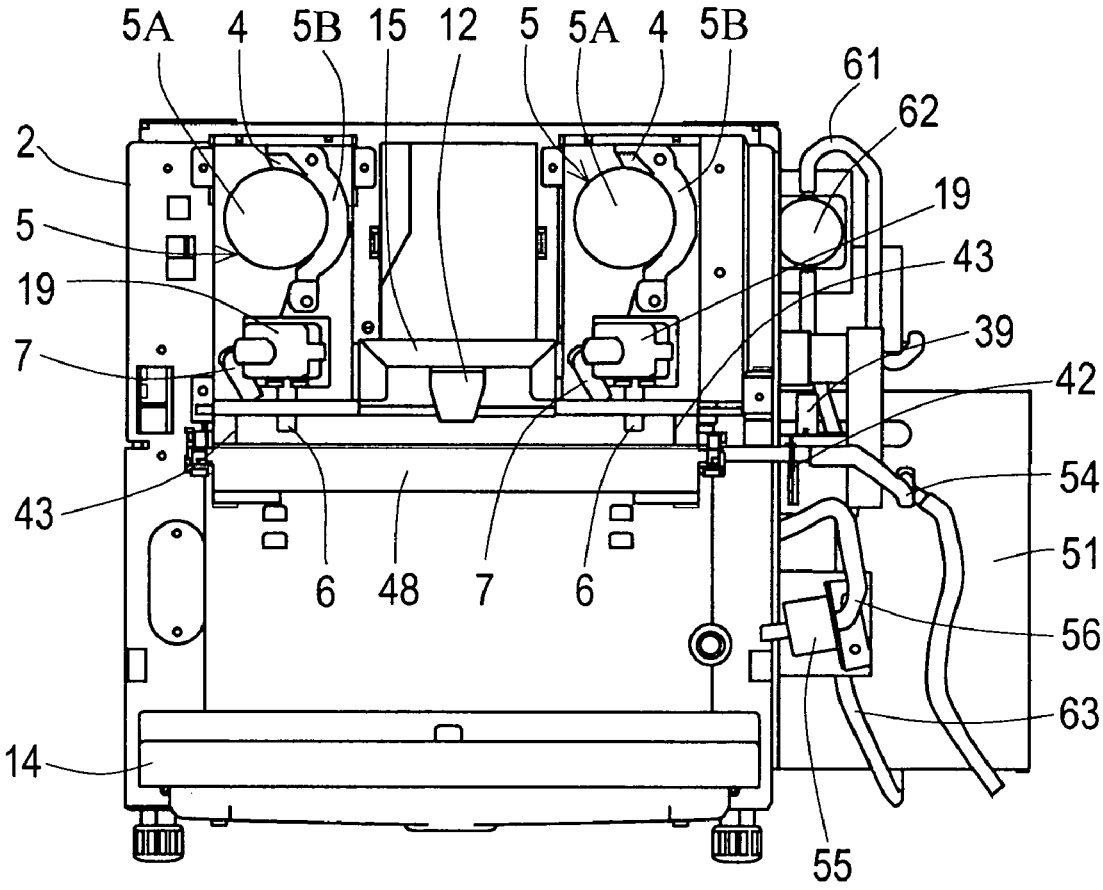
FIG. 12 is a diagram showing a state in which the cleaning nozzle of FIG. 10 faces the beverage supplying nozzles (the state in which the cover is closed and the cleaning nozzle is allowed to face the beverage supplying nozzles).

In the cleaning preparatory step, the control device drives and controls the cover opening and closing motor 49 to close the cover 48 by means of the cover driving device (a state in which the cover 48 is closed and the cleaning nozzle 33 is retreated, see FIGS. 10, 11). Thereafter, the nozzle moving motor 40 is driven and controlled to move the cleaning nozzle 33 from the retreated state to the state in which the nozzle is allowed to face the beverage supplying nozzles 6, 7, and 12 by means of the cleaning nozzle driving device 39 (a state in which the cover 48 is closed and the cleaning nozzle 33 is allowed to face the beverage supplying nozzle, see FIG. 12). Accordingly, the cleaning preparatory step is completed to shift to the next steam jetting step.

In the steam jetting step, the control device energizes the heater 35 of the steam generation device 36 to operate the electromagnetic pump 34. The drain valve 55 only is opened, and the electromagnetic valves 57, 59 and the air electromagnetic valve 62 are closed. The air pump 38 is stopped. Consequently, water pumped up from the water tank 37 by the electromagnetic pump 34 is fed to the steam generation device 36 via the pipe 52. In the steam generation device 36, since the heater 35 is energized, water that has entered the device flows into the cleaning nozzle 33 as the steam via the aspirator 53 and the pipe 54.

The steam that has entered the cleaning nozzle 33 is jetted upwards from the respective discharge ports 33A, 33A, and 33B. The jetted steam is sprayed onto outer faces, peripheries, and inner faces of the respective nozzles 6, 7, and 12. In this case, since the steam is at a high temperature of about +80° C. to +90° C., for example, even the dried and fixed beverage ingredient and another dirt sticking to the inner faces, outer faces, and peripheries of the nozzles 6, 7, and 12 are quickly dissolved.

In the present embodiment, a heater capable of continuously generating the steam for about 30 seconds is used as the heater 35. Therefore, in the steam jetting step, after a continuous operation is performed for about 30 seconds, the heater 35 is preheated for a predetermined time, and the steam is jetted again by the electromagnetic pump 34. It is to be noted that in the present embodiment, the jetting of the steam for about 30 seconds is performed twice or three times.

It is to be noted that the temperature of the steam drops while the steam passes through the cleaning nozzle 33, and the steam turns to water. In this case, since the drain valve 55 is opened, water is discharged from the drain pipe 56 to the drip tray via the drain valve 55. Accordingly, it is possible to discharge water whose temperature has dropped in the cleaning nozzle 33. Therefore, the high-temperature steam only can be discharged to the respective nozzles 6, 7, and 12 via the discharge ports 33A, 33A, and 33B. Therefore, the temperature drop of the steam can be inhibited, and it is possible to further effectively dissolve the beverage ingredient and the other dirt sticking to the inner faces, outer faces, and peripheries of the nozzles 6, 7, and 12.

After completing the steam jetting step, the control device shifts to the water jetting step. In the water jetting step, the control device continuously energizes the heater 35 of the steam generation device 36 to operate the electromagnetic pump 34. The drain valve 55 is closed, and the electromagnetic valve 57 is opened. It is to be noted that in this case, the electromagnetic valve 59 and the air electromagnetic valve 62 are continuously closed. The air pump 38 is also stopped. This raises the temperature of water sucked from the water tank 37 into the aspirator 53 via the pipe 58 owing to the Venturi effect of the aspirator 53 by means of the steam generated by the heater 35 in the same manner as in the steam jetting step, and hot water is supplied to the cleaning nozzle 33.

Hot water that has entered the cleaning nozzle 33 is jetted upwards from the respective discharge ports 33A, 33A, and 33B. The jetted hot water is sprayed onto the outer faces, peripheries, and inner faces of the respective nozzles 6, 7, and 12. This removes the beverage ingredients and the other dirt from the inner faces, outer faces, and peripheries of the nozzles 6, 7, and 12, and further removes the dirt detached in the steam jetting step.

It is assumed that the jetting of water for about 30 seconds is performed twice or three times also in the water jetting step in the same manner as in the steam jetting step. It is to be noted that since the drain valve 55 is closed in this case, the hot water that has entered the cleaning nozzle 33 is discharged from the respective discharge ports 33A, 33A, and 33B without escaping into the drain pipe 56 provided with the drain valve 55. This can secure a force to discharge the hot water, and effectively clean the nozzles 6, 7, and 12.

Especially in such water jetting step, a cleaning effect in the water jetting step can be enhanced using the steam for use in the steam jetting step, and a high cleaning capability can be obtained with a simple constitution.

After the water jetting step is completed, the control device shifts to the draining step. In the draining step, the control device continuously energizes the heater 35 of the steam generation device 36 to operate the electromagnetic pump 34. The device also closes the electromagnetic valve 57, and opens the electromagnetic valve 59 and the drain valve 55. It is to be noted that in this case, the air electromagnetic valve 62 is continuously closed. The air pump 38 is also stopped. Accordingly, air is sucked from the atmospheric air into the aspirator 53 via the pipe 60 owing to the Venturi effect. In this case, the steam generated by the heater 35 is supplied to the aspirator 53 in the same manner as in the steam jetting step. Therefore, air whose temperature has been raised by the steam, that is, the hot air and steam are supplied to the cleaning nozzle 33.

Consequently, in the draining step, the hot air mixed with the steam is jetted upwards from the respective discharge ports 33A, 33A, and 33B of the cleaning nozzle 33. The jetted hot air mixed with the steam is sprayed onto the outer faces, peripheries, and inner faces of the respective nozzles 6, 7, and 12 to blow and fly the water droplets attached to the nozzles 6, 7, and 12 in the water jetting step. Especially, since the hot air includes the high-temperature steam, it is possible to clean, sterilize, and dry the nozzles quickly and securely.

Especially, in such draining step, it is possible to improve a water droplet removing capability in the draining step by use of the steam for use in the steam jetting step, and a high cleaning and drying capability can be obtained with a simple constitution.

It is to be noted that in this case, the temperature of the steam passed through the cleaning nozzle 33 drops, the steam turns to water, and water is discharged from the drain pipe 56 to the drip tray via the drain valve 55 because the drain valve 55 is opened. This makes it possible to discharge water whose temperature has dropped in the cleaning nozzle 33. Therefore, the high-temperature steam only can be discharged from the discharge ports 33A, 33A, and 33B to the nozzles 6, 7, and 12. Consequently, it is possible to inhibit the temperature drop of the steam and effectively blow and fly the water droplets sticking to the inner faces, outer faces, and peripheries of the nozzles 6, 7, and 12. It is also possible to inhibit deterioration of cleaning and drying capabilities.

After executing the draining step for a predetermined time as described above, the control device shifts to the drying step. In the drying step, the control device continuously energizes the heater 35 of the steam generation device 36. The electromagnetic pump 34 stops its operation, whereas the water tank 37 is operated. The control device also opens the air electromagnetic valve 62, and closes the drain valve 55 and the electromagnetic valves 57, 59. Accordingly, air introduced from the air pump 38 is supplied as the hot air from the heater 35 to the cleaning nozzle 33.

The hot air that has entered the cleaning nozzle 33 is jetted upwards from the respective discharge ports 33A, 33A, and 33B. The jetted hot air is sprayed onto the outer faces, peripheries, and inner faces of the nozzles 6, 7, and 12. The water droplets sticking to the inner faces, outer faces, and peripheries of the nozzles 6, 7, and 12 are blown and flied, and dried by means of heat and air. This can realize the effective drying by use of the hot air. It is to be noted that since the drain valve 55 is closed, the hot air can be effectively discharged from the discharge ports 33A, 33A, and 33B, and the effective drying can be realized.

This drying step is continuously performed for a predetermined time, and completed. Therefore, the nozzles 6, 7, and 12 can be dried to hygienically retain the nozzles 6, 7, and 12. Accordingly, the beverage supplying nozzles 6, 7, and 12 can be preferably used. It is to be noted that in the present embodiment, the drying step is completed after the elapse of the predetermined time. However, for example, the drying step may be continuously performed until business is started, and a user may arbitrarily complete the drying step at the start of the business.

After the drying step is completed, the step shifts to the ending step. In the ending step, the control device drives and controls the nozzle moving motor 40, and the cleaning nozzle driving device 39 moves the cleaning nozzle 33 from the state in which the nozzle faces the beverage supplying nozzles 6, 7, and 12 into the retreated state. Thereafter, the cover opening and closing motor 49 is driven and controlled to open the cover 48 by means of the cover driving device. Accordingly, the ending step is completed, and the beverage can be supplied from the beverage supplying nozzles 6, 7, and 12 without being obstructed by the cleaning nozzle 33 or the cover 48.

It is to be noted that the remaining ingredients are removed from the respective nozzles 6, 7, and 12 by means of such cleaning. Therefore, when the store opens the next day, for example, one cup of the beverage ingredient, diluting water or the like is discharged from the nozzles 6, 7, and 12 to bring the beverage dispenser into a standby state.

In the present invention constituted as described above, in the cleaning operation, there are executed the steam jetting step of jetting the high-temperature steam to the beverage supplying nozzles 6, 7, and 12, a water jetting step of jetting the hot water to the nozzles 6, 7, and 12, and the drying step of drying the surfaces of the beverage supplying nozzles 6, 7, and 12, Therefore, the beverage ingredients fixed to the nozzles 6, 7, and 12 can be removed quickly and securely. Moreover, the breeding of miscellaneous bacteria can be inhibited by the high-temperature steam, and the sterilizing can be performed. The dirt detached from the surfaces of the nozzles 6, 7, and 12 by means of the high-temperature steam can be cleaned with the hot water to remove the dirt on the nozzles 6, 7, and 12 more effectively. The nozzles 6, 7, and 12 can be dried to remarkably inhibit a disadvantage that the miscellaneous bacteria breed on the surfaces of the cleaned nozzles 6, 7, and 12, and it is possible to hygienically maintain the beverage supplying nozzles 6, 7, and 12.

Especially in the present embodiment, since the draining step of removing the water droplets from the surfaces of the nozzles 6, 7, and 12 is executed between the water jetting step and the drying step as described above, the water droplets remaining on the beverage supplying nozzles 6, 7, and 12 are reduced, and the subsequent drying step can be efficiently performed. This can realize the efficient drying of the beverage supplying nozzles 6, 7, and 12.

Moreover, in the present embodiment, first the cover 48 is automatically closed by the cover driving device in accordance with user's operation to instruct the cleaning operation. This can prevent the cover 48 from being left open, and it is possible to avoid the disadvantage that the high-temperature steam, hot water or the like flies and scatters around owing to the forgetting to close the cover.

Moreover, since the peripheries of the nozzles 6, 7, and 12 are pervaded with the steam in the cover 48, a cleaning and sterilizing effect is further improved. Since the beverage supplying nozzles 6, 7, and 12 are covered with the cover 48 even after the end of the cleaning operation as described above, it is possible to avoid a disadvantage that the beverage supplying nozzles 6, 7, and 12 are exposed to the outside air, for example, at a standby time after the close of the business.

It is to be noted that in the present embodiment, since the cover 48 covers the lower parts of the beverage supply nozzles 6, 7, and 12, and the front parts of the nozzles 6, 7, and 12 are covered with the main body door 28, the constitution of the cover 48 can be simplified. Since the front parts of the beverage supplying nozzles 6, 7, and 12 are covered with the main body door 28, it is possible to improve cleanability of the nozzles 6, 7, and 12 while securing operability.

Furthermore, the control device controls the cleaning nozzle driving device 39 to drive the cleaning nozzle 33 into the state in which the cleaning nozzle 33 is retreated from the beverage supplying nozzles 6, 7, and 12 and the state in which the cleaning nozzle is allowed to face the nozzles 6, 7, and 12. Consequently, the cleaning nozzle can be appropriately positioned during the cleaning and the dispensing of the beverage. That is, during the cleaning, the cleaning nozzle driving device 39 brings the cleaning nozzle 33 into the state in which the nozzle faces the beverage supplying nozzles 6, 7, and 12 so that it is possible to smoothly execute the operation of cleaning the beverage supplying nozzles 6, 7, and 12. During the supplying of the beverage, that is, the dispensing of the beverage, the cleaning nozzle 33 is retreated so that the beverage can be supplied without being obstructed by the beverage supplying nozzles 6, 7, and 12.

It is to be noted that during the cleaning, the cleaning nozzle driving device 39 may repeatedly move or swing the cleaning nozzle 33 into the retreated state and the state in which the cleaning nozzle faces the nozzles 6, 7, and 12. Accordingly, the cleaning nozzle 33 can effectively jet the high-temperature steam, hot water, drying air and the like to the beverage supplying nozzles 6, 7, and 12. In consequence, the cleaning and drying effect can further be improved.

It is to be noted that in the present embodiment, the cleaning nozzle 33 can be moved into the opposite states along a circular path formed by the guide member 44, but the present invention is not limited to this movement, and the cleaning nozzle may be moved in parallel.

Moreover, in the present embodiment, since the cleaning nozzle 33 is detachably attached to the engaging portion 42A of the arm 42, the cleaning nozzle 33 and the cleaning nozzle driving device 39 can be disengaged to clean the cleaning nozzle 33. Consequently, it is possible to effectively remove water stain, chlorinated lime and the like sticking to the cleaning nozzle 33 and execute the smooth cleaning operation.

It is to be noted that in the present embodiment, the high-temperature steam, hot water, hot air mixed with the steam, and hot air are discharged from the discharge ports 33A, 33A, and 33B of the same cleaning nozzle 33 in the respective steps during the cleaning operation. Therefore, the device can be miniaturized, and the constitution of piping or the like can be simplified.

It is to be noted that in the present embodiment, in the water jetting step, water in the water tank 37 is sucked by use of the Venturi effect due to the aspirator 53, and the hot water is jetted from the discharge ports 33A, 33A, and 33B of the cleaning nozzle 33. Additionally, a gear pump may be used.

Moreover, in the present embodiment, in the water jetting step, the electromagnetic pump 34 is operated to generate the steam and raise the temperature of water for cleaning, but the present invention is not limited to this embodiment, and water at normal temperature may be jetted.

Furthermore, in the present embodiment, in the drying step, air supplied via the air pump 38 is fed to the cleaning nozzle 33, but a duct for discharging dry air may be constituted in the front face of the main body 2 to dry the nozzles 6, 7, and 12 by use of a blower such as a sirocco fan.

In addition, water including detergent in the water tank 37, that is, a cleaning solution may be used as water for use in the cleaning operation. Consequently, the cleaning capabilities of the beverage supplying nozzles 6, 7, and 12 are improved, and even the dirt that cannot be removed in the usual cleaning operation can be effectively removed.

What is claimed is:

1. A beverage dispenser which discharges and supplies beverage ingredients from beverage supplying nozzles, comprising:

a cleaning device to clean the beverage supplying nozzles, further comprising a jetting nozzle to jet fluids onto the beverage supplying nozzles;

a steam generation device, a water source, and an air pump coupled to the jetting nozzle to jet steam, water, and air from the jetting nozzle onto the beverage supplying nozzles;

a control device to control the steam generation device, the water source, and the air pump to execute a cleaning operation including: jetting high-temperature steam to the beverage supplying nozzles; jetting water or hot water to the beverage supplying nozzles; and drying the surfaces of the beverage supplying nozzles; and a cover which covers the beverage supplying nozzles during the cleaning operation.

2. The beverage dispenser according to claim 1, wherein the cleaning device comprises a cover driving device which opens and closes the cover.

3. The beverage dispenser according to claim 1, wherein the cover covers lower parts of the beverage supplying nozzles, and front parts of the beverage supplying nozzles are covered with a main body door.

4. The beverage dispenser according to claim 1, wherein the cleaning device comprises: a water supply pump to pump up water from the water source; and a steam generation device which heats water pumped up from the water supply pump to generate steam, and the cleaning device operates the water supply pump and the steam generation device to supply the steam to the cleaning nozzles in the steam jetting step and sucks water from the water source by use of the steam generated by the steam generation device and an aspirator to supply hot water to the cleaning nozzle in the water jetting step and/or sucks air by use of the steam and the aspirator to supply air to the cleaning nozzle in the draining step.

5. The beverage dispenser according to claim 1, wherein the control device comprises means for jetting high-temperature steam to the beverage supplying nozzles, jetting water or hot water to the beverage supplying nozzles, and drying the surfaces of the beverage supplying nozzles.

6. The beverage dispenser according to claim 2, wherein the control device comprises the cover driving device, and wherein the cover driving device comprises means for opening and closing the cover.

7. The beverage dispenser according to claim 4, wherein the cleaning device further comprises: the air pump, and the cleaning device operates the air pump and the steam generation device to supply, to the cleaning nozzle, hot air obtained by heating air sucked by the air pump by means of the steam generation device in the drying step.

* * * * *